US011006805B2

(12) United States Patent
Lu et al.

(10) Patent No.: US 11,006,805 B2
(45) Date of Patent: May 18, 2021

(54) INFLATION MECHANISM, SYSTEM HAVING THE SAME AND CONTROL METHOD THEREOF

(71) Applicants: LITE-ON ELECTRONICS (GUANGZHOU) LIMITED, Guangzhou (CN); LITE-ON TECHNOLOGY CORPORATION, Taipei (TW)

(72) Inventors: Tien-Sheng Lu, Taipei (TW); Yu-Chung Wu, Taipei (TW)

(73) Assignees: LITE-ON ELECTRONICS (GUANGZHOU) LIMITED; LITE-ON TECHNOLOGY CORPORATION

( * ) Notice: Subject to any disclaimer, the term of this patent is extended or adjusted under 35 U.S.C. 154(b) by 144 days.

(21) Appl. No.: 16/260,907

(22) Filed: Jan. 29, 2019

(65) Prior Publication Data

US 2019/0231162 A1 Aug. 1, 2019

(30) Foreign Application Priority Data

Jan. 31, 2018 (CN) ..... 201810094230.7

(51) Int. Cl.
*A47L 11/40* (2006.01)

(52) U.S. Cl.
CPC ..... *A47L 11/4011* (2013.01); *A47L 2201/04* (2013.01)

(58) Field of Classification Search
CPC ..... A47L 11/4011; A47L 2201/04; A47L 9/2821; A47L 9/2852; A47L 9/2889; A47L 11/24; A47L 11/40; A47L 11/4002; A47L 11/4061
See application file for complete search history.

(56) References Cited

U.S. PATENT DOCUMENTS 5,601,025 A * 2/1997 Box ..... F16L 55/34 104/138.2
6,003,628 A * 12/1999 Jurrens ..... B62K 25/04 180/227

(Continued)

FOREIGN PATENT DOCUMENTS

CN 101211190 A * 7/2008
CN 101211190 B * 5/2010
DE 19654550 A1 * 7/1997 ..... B60R 21/0428

*Primary Examiner* — Darlene P Condra
(74) *Attorney, Agent, or Firm* — Innovation Counsel LLP

(57) ABSTRACT

An inflation mechanism adapted to a robotic device is provided. The inflation mechanism includes a regulating unit and a control unit. The regulating unit includes an inflatable air bag, a pressure detecting unit and a pressure adjusting unit. The inflatable air bag is arranged on a body surface of the robotic device. The pressure detecting unit is coupled to the inflatable air bag for detecting an internal pressure of the inflatable air bag. The pressure adjusting unit is coupled to the inflatable air bag for adjusting the internal pressure of the inflatable air bag. The control unit is coupled to the regulating unit. The control unit processes a signal received from the pressure detecting unit, and determines and controls the pressure adjusting unit to adjust the internal pressure of the inflatable air bag according to a set condition.

21 Claims, 7 Drawing Sheets

(56) References Cited

U.S. PATENT DOCUMENTS

| | | | | |
|---|---|---|---|---|
| 7,137,472 | B2 * | 11/2006 | Aoki | B60R 21/0136 180/274 |
| 2006/0260090 | A1 * | 11/2006 | Kim | G05D 1/0227 15/325 |
| 2008/0117034 | A1 * | 5/2008 | Liao | A47L 9/009 340/438 |
| 2008/0147239 | A1 * | 6/2008 | Chiang | B25J 13/084 700/264 |
| 2013/0152724 | A1 * | 6/2013 | Mozeika | B25J 9/0015 74/490.05 |
| 2015/0088359 | A1 * | 3/2015 | Choi | G05D 1/0225 701/23 |
| 2017/0225321 | A1 * | 8/2017 | Deyle | B25J 9/1679 |
| 2019/0290091 | A1 * | 9/2019 | Liang | A47L 11/24 |

* cited by examiner

INFLATION MECHANISM, SYSTEM HAVING THE SAME AND CONTROL METHOD THEREOF

This application claims the benefit of People's Republic of China application Serial No. 201810094230.7, filed Jan. 31, 2018, the subject matter of which is incorporated herein by reference.

BACKGROUND OF THE INVENTION

Field of the Invention

The invention relates in general to an inflation mechanism, a system having the same and a control method thereof.

Description of the Related Art

Along with the development of the artificial intelligence, the robotic device has been widely used in various fields. Since the working environment of the robotic device has different levels of complexity, the detection or scanning function is still subjected to many restrictions. Therefore, the design of the robotic device needs to consider the situation that the robotic device may collide with an obstacle. Generally speaking, a bumper is disposed at the travelling or operating direction of the robotic device. Or, the obstacle or collision avoidance mechanism of the robotic device can be implemented using an ultrasound sensor, an infra-red sensor and a suitable algorithm.

The ordinary household robotic device, such as the cleaning robot, uses bumper as a means of collision avoidance. However, the traditional bumper has a hard baffle which actuates through the cooperation of springs and micro-switches. After the cleaning robot is used over a period of time, it is inevitable that the cleaning robot may collide or scratch the furniture and leave marks of collision or scratch, or may even topple down valuable objects such as vases, ornaments, or may even move light furniture, such as screens or plastic chairs, and generate undesired displacement. Besides, the traditional bumper is not suitable to be arranged on a large area of the cleaning robot or cover the cleaning robot.

Also, the obstacle or collision avoidance mechanism using an ultrasound sensor or an infra-red sensor may come up with erroneous detection and judgment due to the signal emitting angle, the reflectivity of the object surface, the sound absorbing material or the interference of ambient sounds and lights.

SUMMARY OF THE INVENTION

The invention relates to an inflation mechanism adapted to a robotic device, a system having the same and a control method thereof. According to the embodiments of the invention, the inflation mechanism includes an inflatable air bag formed of a soft material. The inflatable air bag can be disposed at one or more than one specific portion of the robotic device to provide collision protection to the robotic device. Besides, the inflatable air bag, in response to an event or a set condition, can be inflated or deflated to change its volume and implement a specific reaction mechanism.

According to one embodiment of the invention, an inflation mechanism adapted to a robotic device is provided. The inflation mechanism includes a regulating unit and a control unit. The regulating unit includes an inflatable air bag, a pressure detecting unit and a pressure adjusting unit. The inflatable air bag is mounted on a body of the robotic device. The pressure detecting unit is coupled to the inflatable air bag for detecting an internal pressure of the inflatable air bag. The pressure adjusting unit is coupled to the inflatable air bag for adjusting the internal pressure of the inflatable air bag. The control unit is coupled to the regulating unit. The control unit processes a signal received from the pressure detecting unit, and determines and controls the pressure adjusting unit to adjust the internal pressure of the inflatable air bag according to a set condition.

According to another embodiment of the invention, a system including the inflation mechanism is provided.

According to an alternate embodiment of the invention, a control method of an inflation mechanism adapted to a robotic device is provided. The inflation mechanism includes an inflatable air bag, a pressure detecting unit, a pressure adjusting unit and a control unit. The control method includes: detecting an internal pressure of the inflatable air bag by the pressure detecting unit; processing a signal received from the pressure detecting unit, and controlling the pressure adjusting unit by the control unit to adjust the internal pressure of the inflatable air bag according to a set condition.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
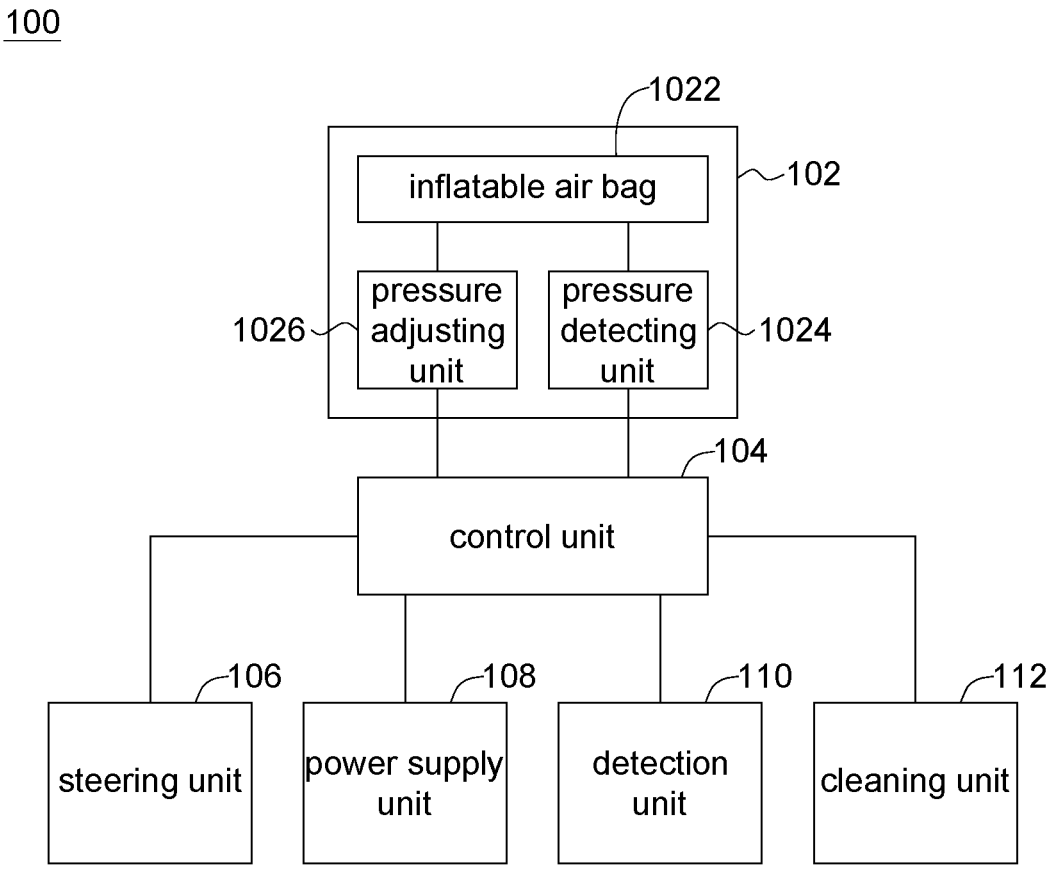
FIG. 1 is a schematic diagram of a robotic device according to an embodiment of the invention.

FIG. 1 is a schematic diagram of a robotic device 100 according to an embodiment of the invention. The robotic device 100 of FIG. 1 can be exemplified by a cleaning robot. As indicated in FIG. 1, the robotic device 100 includes a regulating unit 102, a control unit 104, a steering unit 106, a power supply unit 108, a detection unit 110 and a cleaning unit 112.

The regulating unit 102 includes an inflatable air bag 1022, a pressure detecting unit 1024 and a pressure adjusting unit 1026. The inflatable air bag 1022 can be exemplified by such as a hollow annular tube or a bag formed of rubber or other soft material. The shape of the inflatable air bag 1022 can match the casing of the robotic device 100, such that the inflatable air bag 1022 is suitable for being arranged on the body surface of the robotic device 100.

The pressure detecting unit 1024 is coupled to the inflatable air bag 1022 for detecting an internal pressure of the inflatable air bag 1022. For example, the pressure detecting unit may include one or more than one pressure detector coupled to the inflatable air bag 1022 through a tube for detecting an internal pressure of the inflatable air bag 1022.

The pressure adjusting unit 1026 is coupled to the inflatable air bag 1022 for adjusting the internal pressure thereof. In an embodiment, the pressure adjusting unit 1026 may include a pressing motor and a pressure regulating valve. The pressure regulating valve can be exemplified by such as a pressure controlling solenoid valve, or any controlling valve that can selectively open or close gas channels. In another embodiment, the pressure regulating valve can be omitted; the pressure adjusting unit 1026 can dynamically inflate the inflatable air bag 1022 using the pressing motor to maintain the internal pressure of the inflatable air bag 1022 at a preset pressure level.

The control unit 104 is coupled to the regulating unit 102, the steering unit 106, the power supply unit 108, the detection unit 110 and the cleaning unit 112. The control unit 104 can be exemplified by such as a microprocessor, a microcontroller, a chip, a circuit board or other circuit with computation function. The control unit 104 controls and coordinates with the operation of each element coupled thereto, such that the robotic device 100 can complete one or more than one specific operation. For example, the control unit 104 can enable the steering unit 106 according to the sensed data collected by the detection unit 110, such that the robotic device 100 can move or operate according to a specific path. The detection unit 110 may include an ultrasound sensor, an infra-red sensor, a gyro, an accelerometer or the like. The control unit 104 also can enable the cleaning unit 112 to drive its cleaning components to perform the operations such as cleaning and dust collection when the robotic device 100 moves. The cleaning unit 112 may include components such as a dust collection motor, a number of rollers, and a brush. The steering unit 106 may include components such as a motor and a number of steering wheels. Besides, the power supply unit 108 mainly provides the power necessary for the operation of each component of the robotic device 100. The power supply unit 108 can be charged when the robotic device 100 returns to the dock.

The regulating unit 102 working in conjunction with the control unit 104 can be regarded as an inflation mechanism of the robotic device 100. The control unit 104 receives a signal from the pressure detecting unit 1024 of the regulating unit 102, processes and determines the received signal, and then controls the pressure adjusting unit 1026 to adjust the internal pressure of the inflatable air bag 1022. Through the use of suitable algorithms, the control unit 104, in response to different events/situations, can control the pressure adjusting unit 1026 to inflate or deflate the inflatable air bag 1022, such that the robotic device 100 can implement a specific reaction mechanism such as obstacle avoidance, collision avoidance, escape or interaction. Detailed descriptions are disclosed later.

In an embodiment, the control unit of the inflation mechanism and the control unit controlling the robotic device to perform actions can be independent of each other, and the inflation mechanism can be modularized and installed on various types of robotic devices.

Although the robotic device 100 of FIG. 1 is exemplified by a cleaning robot, the invention is not limited thereto. The inflation mechanism of the invention can be used in various types of robotic devices, such as a robotic arm or a self-propelled robot. The said robotic device with an inflation mechanism can be regarded as a system. Let the robotic arm be taken for example. The inflatable air bag can be arranged on a specific portion of the robotic arm. Based on the internal pressure of the inflatable air bag detected by the pressure detecting unit, the control unit of the robotic arm can control the pressure adjusting unit to inflate or deflate the inflatable air bag to implement various functions such as holding or gripping. For example, the robotic arm can perform different gestures such as holding, releasing and exploring by suitably inflating or deflating the inflatable air bag. Notably, the control unit of the robotic arm can be installed independently, or installed internally or externally at existing equipment without affecting a physical structure thereof.

For the invention to be better understood, in the following descriptions of FIGS. 2A to 2B and FIGS. 3A to 3C, the robotic device is exemplified by a cleaning robot. However, it should be noted that the invention is not limited thereto.

Figure 2A:
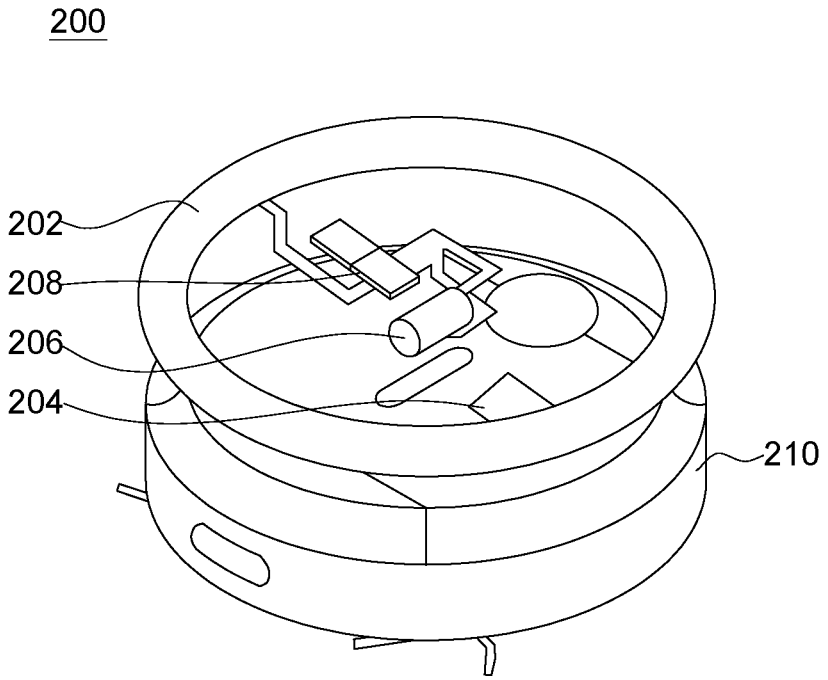
FIG. 2A is an explosion diagram of a cleaning robot equipped with an inflation mechanism according to an embodiment of the invention.
Figure 2B:
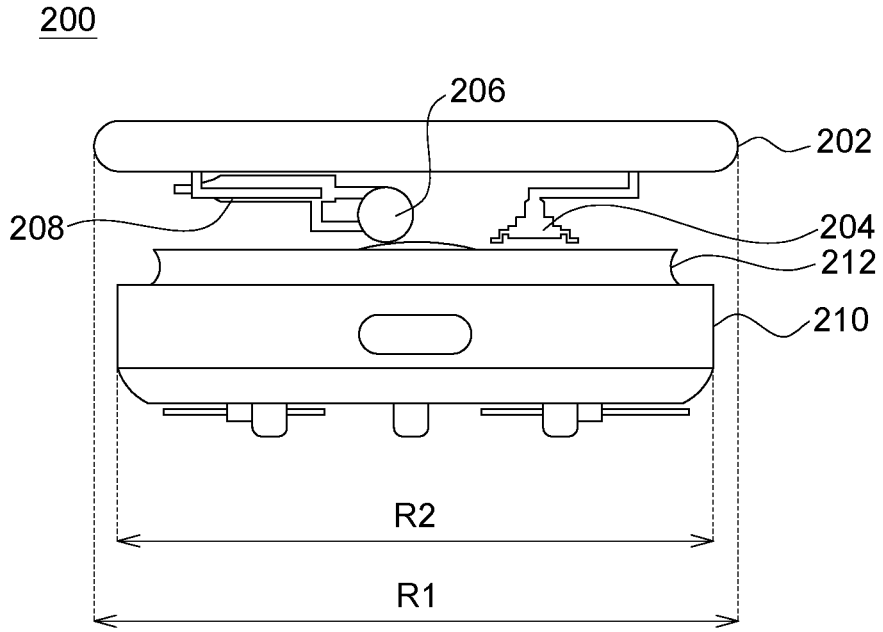
FIG. 2B is a side view of the cleaning robot of FIG. 2A.

Refer to FIG. 2A and FIG. 2B. FIG. 2A is an explosion diagram of a cleaning robot 200 equipped with an inflation mechanism according to an embodiment of the invention. FIG. 2B is a side view of the cleaning robot 200 of FIG. 2A.

The cleaning robot 200 includes a body 210, an inflatable air bag 202, having an inner chamber which can be inflated by filling air or gas, mounted on the body 210, a pressure detecting unit 204 for detecting an internal pressure of the inflatable air bag 202, a pressing motor 206 for inflating the inflatable air bag 202, and a pressure regulating valve 208 for maintaining the internal pressure of the inflatable air bag 202 or quickly inflating/deflating the inflatable air bag 202. The inflatable air bag 202, the pressure detecting unit 204, the pressing motor 206 and the pressure regulating valve 208 correspond to the regulating unit 102 of FIG. 1. The said components together with the control unit (not illustrated in FIGS. 2A, 2B) in charge of the control of each unit can be modularized as an inflation mechanism mounted on the body 210 and electrically coupled to the cleaning robot 200. In other implementations, the pressure detecting unit 204, the pressing motor 206, the pressure regulating valve 208 and the control unit can be embedded in the body 210, but the invention is not limited thereto.

Refer to FIG. 2B. An engagement portion 212 is disposed at the junction between the top surface and the peripheral side surface of the body 210 for arranging the inflatable air bag 202 on the body 210. In other implementations, the body 210 can have multiple engagement portions 212 disposed thereon. The quantity and position of the engagement portion 212 are not limited to the above exemplification. Also, the surface curvature or the shape of the engagement portion 212 can be determined according to the design needs of the inflatable air bag 202.

In the present embodiment, the inflatable air bag 202 is an annular tube suitable to be mounted on the engagement portion 212 of the body 210. After the inflatable air bag 202 is inflated, the outer diameter R1 of the inflatable air bag 202 is greater than the body diameter R2 of the cleaning robot 200, such that the body 210 can be protected. The outer surface of the inflatable air bag 202 may include a fixing mechanism (not illustrated), such as a latch, for fixing the inflatable air bag 202 on the body 210. In other implementations, the body 210 may include a fixing mechanism (not illustrated) working in conjunction with the inflatable air bag 202 for mounting the inflatable air bag 202 on the body 210.

In other embodiments, the inflatable air bag 202 can be mounted at other position of the body 210, such as at a particular horizontal height of the peripheral side surface. The cleaning robot 200 may include multiple inflatable air bags 202 respectively disposed at different positions of the body 210. For example, the body 210 may have inflatable air bags 202 arranged on the upper position and/or the lower position of the peripheral side surface to provide more comprehensive protection. Also, the design of multiple inflatable air bags 202 is beneficial for the control unit to identify obstacle types. For example, if the event only occurs to the inflatable air bag 202 located at the upper position of the peripheral side surface (for example, the internal pressure of the inflatable air bag 202 which is equal to or greater than a predetermined value is detected, or an amount of change in the internal pressure of the inflatable air bag exceeds a critical threshold), the control unit can identify and determine that the type of the obstacles encountered such as the bottom edge of a bed, the bottom edge of a cabinet or the bottom edge of a sofa. If the event only occurs to the inflatable air bag 202 located at the lower position of the peripheral side surface (for example, the internal pressure of the inflatable air bag 202 which is equal to or greater than a predetermined value is detected, or an amount of change in the internal pressure of the inflatable air bag exceeds a critical threshold), the control unit can identify and determine that the type of the obstacles encountered such as a raised protrusion on the floor surface or other stationary object located on the floor surface. If the event occurs to the two inflatable air bags 202 on both the lower position and the upper position of the peripheral side surface at the same time (for example, the internal pressure of each inflatable air bag 202 which is equal to or greater than a predetermined value is detected, or an amount of change in the internal pressure of the inflatable air bag exceeds a critical threshold), the control unit can identify and determine that the type of the obstacles encountered such as a wall or other essentially vertical obstacles. Based on the obstacle types, the control unit can determine and designate suitable avoidance measures. For example, the control unit may deflate the inflatable air bag 202 to reduce the overall height of the cleaning robot and could escape from or enter into the underneath of the bed.

The pressure detecting unit 204, such as a pressure detector, is coupled to the inflatable air bag 202 through a tube for sensing an internal pressure of the inflatable air bag 202. The pressure detecting unit 204 outputs the detection result to the control unit.

After the control unit receives the detection signal output from the pressure detecting unit 204 and determines that an event occurs (for example, the internal pressure of the inflatable air bag 202 which is equal to or greater than a predetermined value is detected, or an amount of change in the internal pressure of the inflatable air bag exceeds a critical threshold), the control unit outputs a signal for controlling the pressing motor 206, such as an air generator. The pressing motor 206 is coupled to the inflatable air bag 202 through the tube in communication with a pressure-regulated source of air or other gas to inflate the inflatable air bag 202. The pressure regulating valve 208 can be arranged on the gas communication path between the inflatable air bag 202 and the pressing motor 206. The pressure regulating valve 208 is joined to the inflatable air bag 202 for allowing inflation or deflation thereof. The pressure regulating valve 208 can close the gas communication path to maintain the internal pressure of the inflatable air bag 202 or can guide the inflatable air bag 202 to the ventilation port to quickly decrease the internal pressure of the inflatable air bag 202. The pressure regulating valve 208 is designed to release air from the inflatable air bag 202 depending on the internal pressure therein.

Figure 3A:
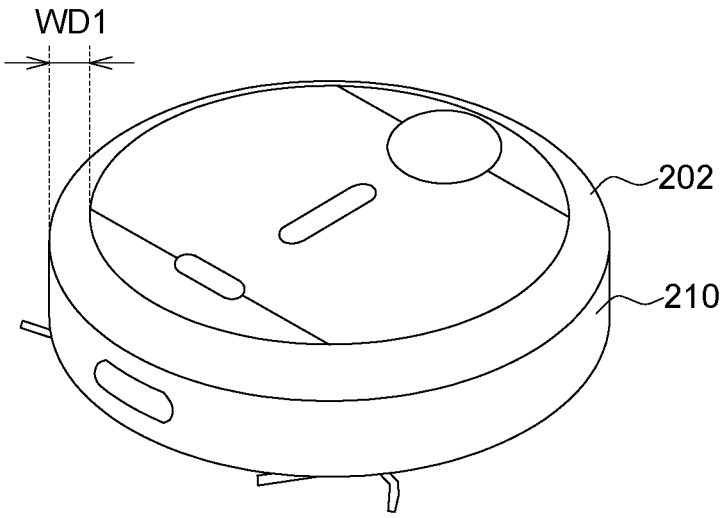
FIGS. 3A to 3C illustrate various inflation states or stages in the inflatable air bag of a cleaning robot.
Figure 3B:
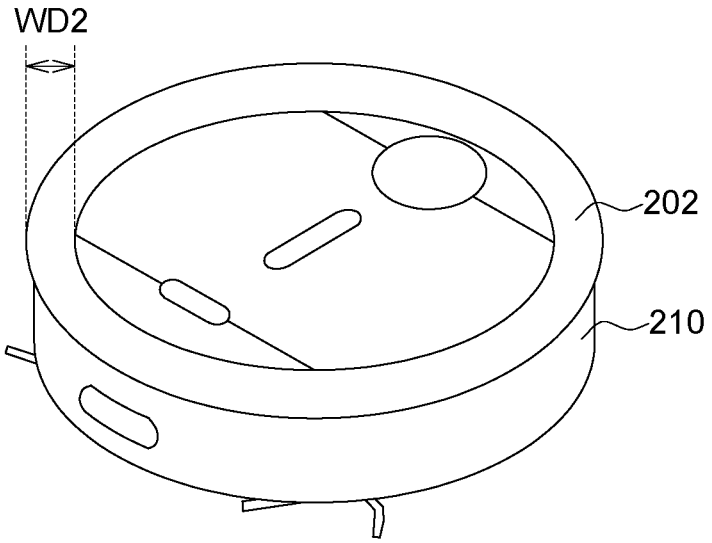
Figure 3C:
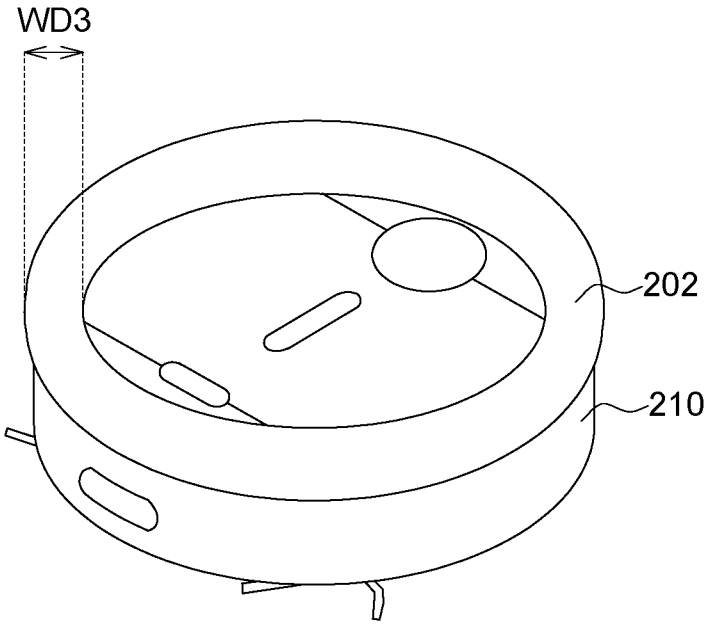

Referring to FIGS. 3A to 3C, which present various inflation states or stages in an inflatable air bag 202 of a cleaning robot 200. The inflatable air bag 202 can be inflated with different widths and volumes under various states or stages of inflation. As shown in FIGS. 3A to 3C, illustrated the change in width due to the increase in inflation. Along with the increase in the volume of inflation, the difference between the outer diameter and the inner diameter of the inflatable air bag 202 sequentially increases to WD2 from WD1, and further increases to WD3 from WD2. The larger the degree of inflation, the larger the volume of the inflatable air bag 202. Depending on actual needs, the user can set the degree of inflation to the inflatable air bag 202, such that the cleaning robot 200 can be adapted to a specified working environment, and the cleaning robot 200 can be adjusted to a safety distance/height with respect to ambient objects.

Figure 4:
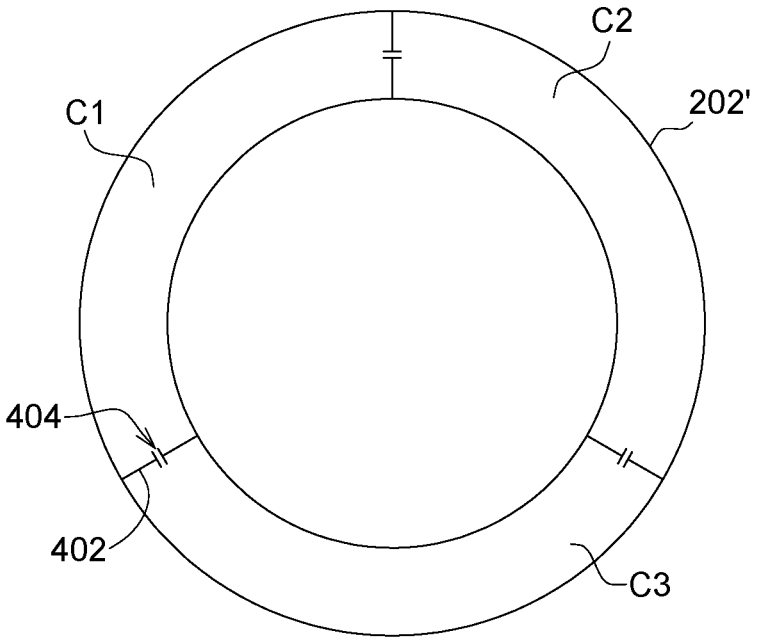
FIG. 4 schematically shows the interior of an inflatable air bag divided into multiple chambers.

In an embodiment, the interior of the inflatable air bag 202 includes partition walls to divide the inner chamber of the inflatable air bag 202 into multiple adjacent sub-chambers. As indicated in FIG. 4, the interior of the inflatable air bag 202' includes three partition walls 402 dividing the interior of the inflatable air bag 202' into three sub-chambers C1, C2 and C3. Based on the configured inflatable air bag 202', the pressure detecting unit (not illustrated) may include multiple pressure detectors respectively coupled to sub-chambers C1, C2 and C3 for detecting the internal pressure of each of sub-chambers C1, C2 and C3. Thus, the control unit (not illustrated) can determine the position of an obstacle according to the change of the internal pressure in sub-chambers of the inflatable air bag 202'. For example, when the pressure detecting unit detects that the chamber pressure of the sub-chamber C1 suddenly becomes much higher than that of the sub-chambers C2 and C3, the control unit can identify that the obstacle is located at a radial position of the sub-chamber C1.

In an embodiment, each partition wall 402 has at least an air hole (gas hole) 404 for allowing air or gas communication between the sub-chambers C1, C2 and C3. Based on the said arrangement, all of the sub-chambers C1, C2 and C3 of the inflatable air bag 202' can be inflated or deflated by one pressing motor and one pressure regulating valve. On the other hand, the size of the air hole (gas hole) 404 can be designed in a way that the chamber pressures of the sub-chambers C1, C2 and C3 take a predetermined period of time to achieve balance. Thus, in response to the event, the result in a chamber pressure increase in one of the sub-chambers C1, C2 and C3 can be detected by the pressure detecting unit within a very short period of time.

Although the inflatable air bag 202' of FIG. 4 is divided into three sub-chambers C1, C2 and C3, the invention is not limited thereto. The inner chamber of the inflatable air bag can be divided into any number of sub-chambers having identical or different sizes.

Figure 5:
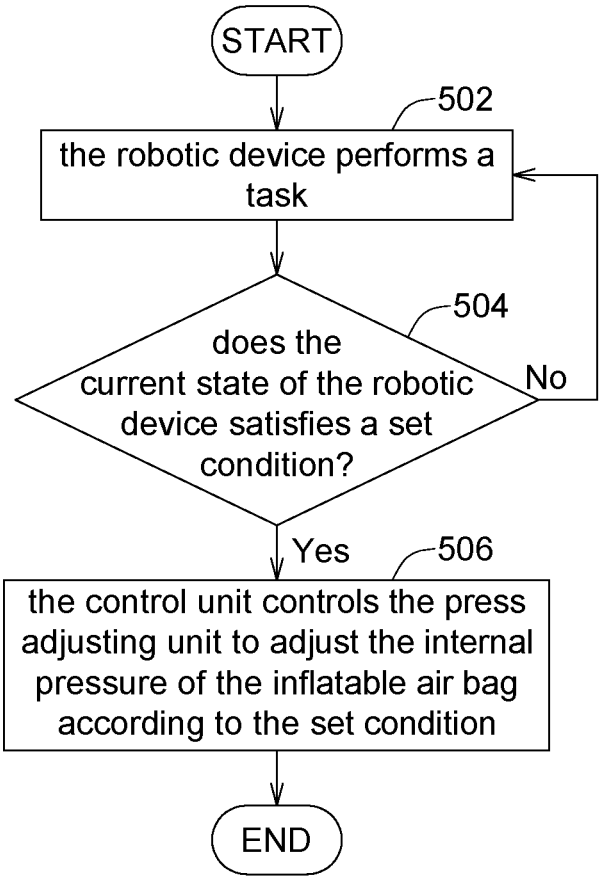
FIG. 5 is a control method used in an inflation mechanism of a robotic device according to an embodiment of the invention.

FIG. 5 is a control method used in an inflation mechanism of a robotic device according to an embodiment of the invention. The inflation mechanism may include a pressure control and collision detecting unit (such as the regulating unit 102 of FIG. 1) and a control unit (such as the control unit 104 of FIG. 1).

In step 502, the robotic device performs a task, wherein the type of the task depends on the type of the robotic device. One example of the robotic device illustrated in an embodiment is a cleaning robot. The task may include a cleaning task and an environment detection task. In an embodiment, the robotic device may perform a specific task in response to the user's input. That is, when a predetermined condition is set by user, a predetermined operation of the robotic device can be performed if the predetermined condition (i.e. a set condition) has been satisfied.

In step 504, the control unit determines whether the current state of the robotic device satisfies a set condition. Let FIG. 1 be taken for example. The control unit 104 can process a signal received from the pressure detecting unit 1024 and/or the detection unit 110, and then determines whether the current state of the robotic device satisfies the set condition according to the received signal.

The set condition refers to a situation that can be defined according to the state of the robotic device and/or the change of the internal pressure of the inflatable air bag, such as an amount of inflation of the inflatable air bag, the degree of expansion of the inflatable air bag and the position of the robotic device when inflation is triggered. The state of the robot refers to the position of the robotic device, the degree of inclination of the body and/or other attributes or values used for describing the operating state of the robotic device. The change of the internal pressure of the inflatable air bag refers to the increase or decrease in the internal pressure of the inflatable air bag within a certain period of time, an amount of change in the internal pressure or the magnitude of the abrupt pressure change (that is, the magnitude of a force applied to the inflated air bag). For example, if the set condition refers to the situation that the robotic device moves to a specific area within the predetermined area, the control unit determines that the current state (e.g. position) of the robotic device matches the set condition when the robotic device moves to the specific area.

In an embodiment, the user can input a set condition through a human-machine interface provided by the robotic device. In another embodiment, the set condition can be preset in the robotic device when the robotic device at the factory.

If the determination result of step 504 is "yes", then the flow enters step 506. Otherwise, it enters step 502. In step 506, the control unit controls the pressure adjusting unit (such as the pressure adjusting unit 1026 of FIG. 1) to adjust the internal pressure of the inflatable air bag according to the set condition. For example, the pressure adjusting unit inflates or deflates the inflatable air bag or maintains the pressure of the inflatable air bag to implement a specific reaction mechanism, such as a collision avoidance mechanism, an escape mechanism, an interactive mechanism or a travel path protection mechanism.

The invention is further described using the cleaning robot 200 of FIG. 2A and FIG. 2B as an example. When the cleaning robot 200 is started up, the control unit transmits an activation signal to activate the inflation mechanism and inflate the inflatable air bag 202 to an initial state (as illustrated in FIG. 3B). For example, the inflatable air bag 202 is inflated to a preset pressure level. Then, the cleaning robot 200 determines whether the cleaning robot 200 moves to a specific area (determines whether the set condition is matched) according to the data (such as the movement trajectory) collected by an internal sensor. If the determination result is "yes", then the control unit controls the inflatable air bag 202 to be inflated to 100% of the maximum bag capacity (as illustrated in FIG. 3C), such that the cleaning robot 200 can have a larger height and becomes less likely to be accidentally jammed a narrow gap under an obstacle (e.g., beneath a bed or a sofa).

The implementation of different mechanisms of the invention is described below with accompanying drawings. However, it should be understood that the description below is non-limiting, and is for elaborating some aspects of the invention in a simplified manner.

I. Escape Mechanism

Figure 6:
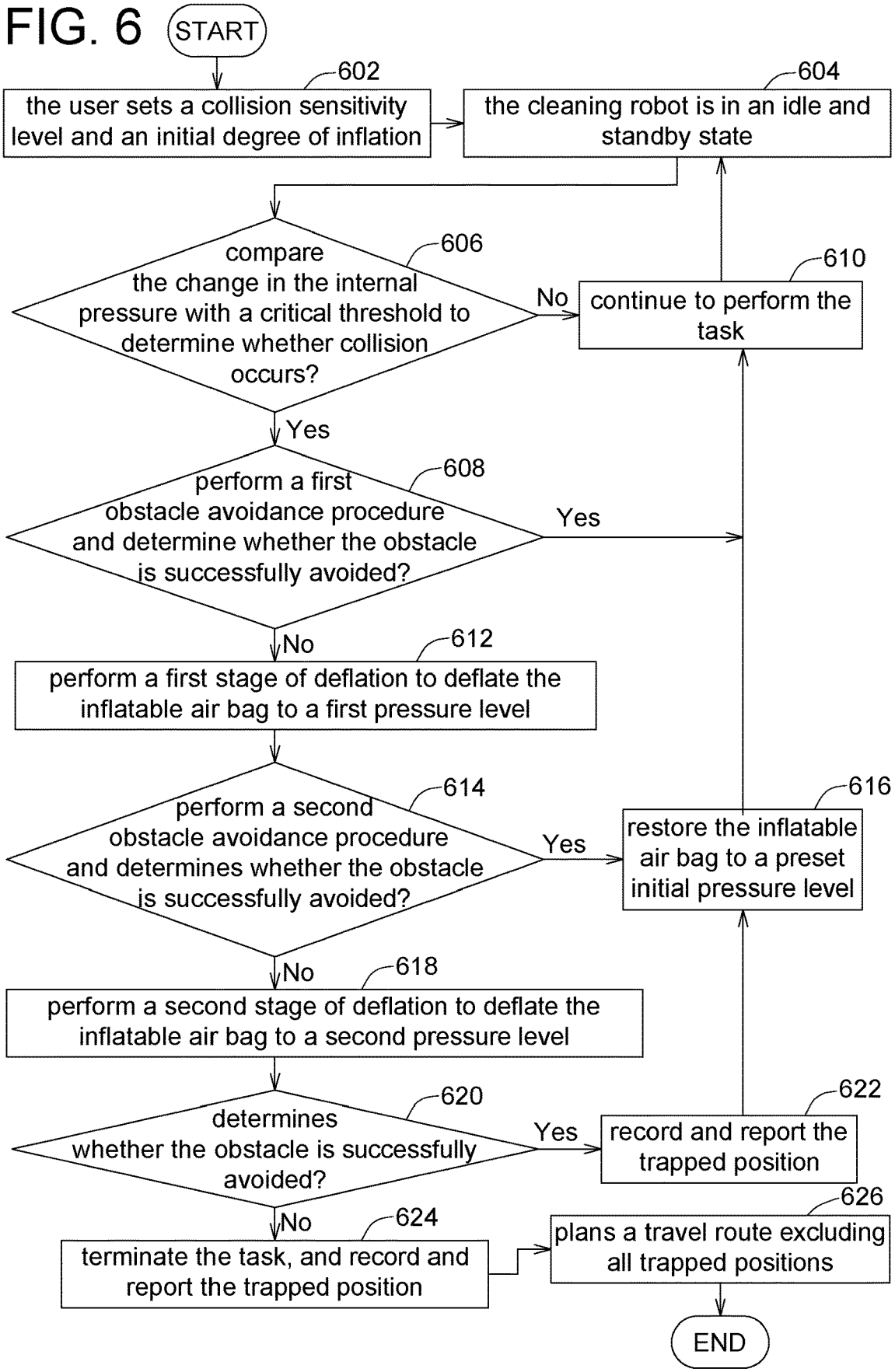
FIG. 6 is a control method used in an inflation mechanism of a robotic device according to another embodiment of the invention.

FIG. 6 is a control method used in an inflation mechanism of a robotic device according to another embodiment of the invention. An escape mechanism is shown, in accordance with the exemplary embodiment. Generally speaking, it is commonly seen that the cleaning robot may be jammed in a narrow horizontal gap under an obstacle (e.g., beneath a bed or a sofa) or a narrow vertical gap (such as the gap defined by desk legs and chair legs). According to the present embodiment, a single staged or multi staged inflatable air bag can be controlled by the pressure adjusting unit to perform one or more deflation stages to reduce the volume of the inflatable air bag, such that the robotic device (e.g., cleaning robot) can escape from the narrow space formed in the obstacle.

For example, the control unit identifies an event according to the change of the internal pressure of the inflatable air bag. The word "event" as used herein, may refer to any event that the internal pressure of the inflatable air bag changes when the inflatable air bag is touched or collided. For example, the air bag is lightly touched or collides with an obstacle. Based on the magnitude of the change of the internal pressure of the inflatable air bag, the control unit can identify the type of the event according to the degree of collision or compression. For example, if it is detected that the internal pressure variation within the inflatable air bag exceeds a critical threshold, then the control unit determines that the inflation mechanism collides with an obstacle. If it is detected that the internal pressure of the inflatable air bag increases but the amount of change in the internal pressure is still lower than a critical threshold, then the control unit determines that the inflation mechanism is lightly touched or does not collide with any obstacle. The said critical threshold can be determined according to the sensitivity level related to the control unit for detecting the pressure.

In response to the event, the control unit controls the robotic device to perform a first obstacle avoidance procedure, such as turning the direction of the robotic device or changing the travel route. If the robotic device performs the first obstacle avoidance procedure but still cannot avoid the obstacle, then a first stage of deflation is performed. In the first stage of deflation, the control unit controls the pressure adjusting unit to deflate the inflatable air bag until the internal pressure of the inflatable air bag drops to a first pressure level, such as 50% of the maximum bag capacity to reduce the volume of the inflatable air bag, such that the robotic device can escape from the obstacle.

After the volume of the inflatable air bag is reduced, the control unit controls the robotic device to perform a second obstacle avoidance procedure, such as turning the direction of the robotic device or changing the travel route again. If the robotic device performs the second obstacle avoidance procedure and successfully escapes from the obstacle, the control unit controls the pressure adjusting unit to inflate the inflatable air bag until the internal pressure of the inflatable air bag increases to a preset initial pressure level, such as 100% of the maximum bag capacity. On the contrary, if the robotic device performs the second obstacle avoidance procedure but still cannot escape from the obstacle, then a second stage of deflation is performed. In the second stage of deflation, the control unit controls the pressure adjusting unit to deflate the inflatable air bag until the internal pressure of the inflatable air bag drops to a second pressure level (such as the air bag is substantially completely deflated). Meanwhile, the control unit records and/or reports the trapped position of the robotic device to the administration platform or the user. Then, based on the trapped position information, the control unit plans a travel route of the robotic device, which excludes the trapped position to avoid the robotic device being trapped again. In the embodiment, the initial pressure level is higher than the first pressure level, and the first pressure level is higher than the second pressure level, but is not limited thereto. And, the number of stages of deflation in the obstacle avoidance procedure is not limited to two. In an alternative embodiment, depending on actual needs, the number of stages of deflation in the obstacle avoidance procedure can be single or multiple.

The illustration of the above and the detailed description hereafter are used to demonstrate and explain one of the embodiments of the invention. In the present embodiment, the robotic device is exemplified by (but is not limited to) a cleaning robot.

In step 602, the user sets a collision sensitivity level and an initial degree of inflation on the cleaning robot. The higher the collision sensitivity level, the more likely the control unit will regard a slight change of the pressure of the inflatable air bag as an event of collision. The initial degree of inflation refers to the degree of inflation to which the cleaning robot inflates the inflatable air bag when the cleaning robot is started up.

In step 604, the cleaning robot is in an idle and standby state. For example, the cleaning robot waits for the user to activate a cleaning instruction or a map construction instruction.

In step 606, during the normal operation period of the cleaning robot (such as the period that the cleaning robot performs cleaning or environment detection), the control unit determines whether collision occurs according to a change of the internal pressure of the inflatable air bag. If "yes" (for example, the amount of change in the internal pressure of the inflatable air bag exceeds a critical threshold), then the flow enters step 608 in which the cleaning robot performs a first obstacle avoidance procedure and determines whether the obstacle is successfully avoided. If the determination result is "yes", then the flow enters step 610 in which the cleaning robot continues to perform the task (such as cleaning or environment detection) until the task is completed. Then, the flow returns to step 604. If the determination result is "no", then the flow enters step 612.

In step 612, when the cleaning robot is trapped by an obstacle and cannot escape, the control unit performs a first stage of deflation to deflate the inflatable air bag until the internal pressure of the inflatable air bag drops to a first pressure level (such as 50% of the maximum bag capacity) to reduce the volume of the inflatable air bag.

Then go to step 614, the control unit performs a second obstacle avoidance procedure and determines whether the obstacle is successfully avoided. If "yes", then go to step 616, in which the control unit restores the inflatable air bag to a preset initial pressure level, such as 100% of the maximum bag capacity. If "no", then go to step 618, in which the control unit performs a second stage of deflation to deflate the inflatable air bag until the internal pressure of the inflatable air bag drops to a second pressure level (such as the air bag is substantially completely deflated). Then, go to step 620, the control unit again determines whether the obstacle is successfully avoided.

If it is determined that the obstacle is successfully avoided, then the method sequentially proceeds to step 622 and step 616. In step 622, the control unit records and reports the trapped position, and then proceeds to step 616. In step 616, the inflatable air bag is inflated until the internal pressure of the inflatable air bag increases to a preset pressure level, such that the cleaning robot can continue to perform the task.

If the control unit determines that the cleaning robot may be stuck on an obstruction (that is, the cleaning robot has been stuck and cannot free itself), then go to step 624, in which the cleaning robot terminates the task, and records and reports the trapped position and waits for the user to solve the above problem. In step 626, the control unit, unless the cleaning robot is reset by the user, plans a travel route excluding all trapped positions.

II. Interactive Mechanism

In one embodiment, the control unit, in response to the event, controls the pressure adjusting unit to inflate or deflate the inflatable air bag to represent different interactions. For example, the control unit can control the inflatable air bag to be expanded or contracted to represent different anthropomorphic action with emotions, such as angry or happy; or the control unit can enable specific operations of the robotic device in response to different events. For example, specific operations, such as cleaning, environment detection or returning to the charge dock, can be activated according to the number of times for which, the position at which, and the magnitude of force with which the air bag is tapped or kicked.

Figure 7:
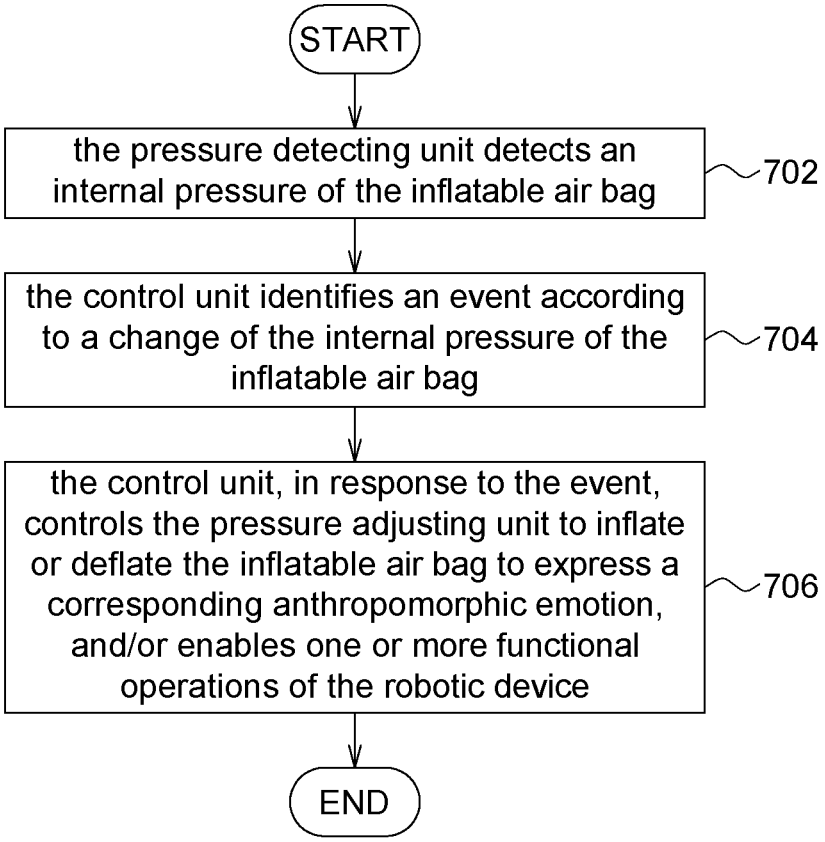
FIG. 7 is a control method used in an inflation mechanism of a robotic device according to another embodiment of the invention.

FIG. 7 is a control method used in an inflation mechanism of a robotic device according to another embodiment of the invention.

In step 702, the pressure detecting unit detects an internal pressure of the inflatable air bag.

In step 704, the control unit identifies an event according to a change of the internal pressure of the inflatable air bag. For example, when the pressure detecting unit detects that the change of the internal pressure of the inflatable air bag reaches a preset level or an amount of change in the internal pressure of the inflatable air bag exceeds a critical threshold, the control unit determines that the change of the internal pressure matches a set condition and continues to perform step 706.

In step 706, the control unit, in response to the event, controls the pressure adjusting unit to inflate or deflate the inflatable air bag to express a corresponding anthropomorphic emotion, and/or enables one or more functional operations of the robotic device. For example, the control unit, after identifying an event, determines that the change of the internal pressure matches a set condition, such as an anthropomorphic emotion setting corresponding to the event and further control the pressure adjusting unit to adjust the internal pressure of the inflatable air bag to expand or contract the inflatable air bag according to the anthropomorphic emotion setting. For example, the inflatable air bag is expanded to represent the anthropomorphic emotions such as happy or excited. Or, the control unit, after identifying an event, determines a functional operation corresponding to the event and enables a functional operation. For example, the control unit activates a cleaning procedure in response to the user's kicking the inflatable air bag lightly.

III. Travel Path Protection Mechanism

According to the present embodiment, the control unit, based on the setting of the user or the manufacturer, can control the pressure adjusting unit to inflate the inflatable air bag to increase the overall volume or the height when the robotic device is started up or reaches a specific area (matching a set condition), so as to avoid the robotic device entering a narrow space (e.g., the space under a bed or a sofa) undesired by the user.

Let the cleaning robot be taken for example. The user does not want the cleaning robot to enter a narrow horizontal gap, in which the cleaning robot may be easily trapped (such as the underneath of the bed or the sofa), but the environmental sensor of the cleaning robot determines that the narrow horizontal gap is accessible. Therefore, the user can input a set condition beforehand, such that the cleaning robot is inflated to a certain degree of inflation to increase its volume when the cleaning robot is started up or near the specific areas. Thus, the same function as an infra-red virtual wall, which prevents the cleaning robot from entering the narrow horizontal gap, can be generated.

To sum up, the invention relates to an inflation mechanism adapted to a robotic device, a system having the same and a control method thereof. According to the embodiments of the invention, the inflation mechanism includes an inflatable air bag formed of a soft material. The inflatable air bag can be disposed at one or more specific portion of the robotic device to provide collision protection thereto. Besides, the inflatable air bag, in response to an event or a set condition, can be inflated or deflated to change its volume and implement a specific reaction mechanism.

While the invention has been described by example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An inflation mechanism adapted to a robotic device, wherein the inflation mechanism comprises:

a regulating unit, comprising:

an inflatable air bag mounted on a body of the robotic device;

a pressure detecting unit coupled to the inflatable air bag for detecting an internal pressure of the inflatable air bag; and a pressure adjusting unit coupled to the inflatable air bag for adjusting the internal pressure of the inflatable air bag; and a control unit coupled to the regulating unit for processing a signal received from the pressure detecting unit and controlling the pressure adjusting unit to adjust the internal pressure of the inflatable air bag according to a set condition which refers to an amount of change in the internal pressure of the inflatable air bag, wherein the control unit identifies an event according to the amount of change in the internal pressure of the inflatable air bag and outputs a signal for controlling the pressure adjusting unit to adjust the internal pressure of the inflatable air bag according to the identified event, and the control unit is further used for:

controlling, in response to the event, the robotic device to perform a first obstacle avoidance procedure; and controlling, in response to a situation that the robotic device performs the first obstacle avoidance procedure but still cannot avoid the obstacle, the pressure adjusting unit to deflate the inflatable air bag until the internal pressure of the inflatable air bag drops to a first pressure level from an initial pressure level and a volume of the inflatable air bag is reduced.

2. The inflation mechanism according to claim 1, wherein the control unit is further used for:

controlling, in response to the event, the pressure adjusting unit to inflate or deflate the inflatable air bag to present an anthropomorphic emotion setting, or enabling one or more functional operations of the robotic device.

3. The inflation mechanism according to claim 1, wherein the control unit is further used for:

controlling, in response to a situation that the internal pressure drops to the first pressure level, the robotic device to perform a second obstacle avoidance procedure;

controlling, in response to a situation that the robotic device performs the second obstacle avoidance procedure and successfully avoids the obstacle, the pressure adjusting unit to inflate the inflatable air bag until the internal pressure of the inflatable air bag increases to the initial pressure level; and controlling, in response to a situation that the robotic device performs the second obstacle avoidance procedure but still cannot avoid the obstacle, the pressure adjusting unit to deflate the inflatable air bag until the internal pressure of the inflatable air bag drops to a second pressure level;

wherein the second pressure level is lower than the first pressure level, and the first pressure level is lower than the initial pressure level.

4. The inflation mechanism according to claim 3, wherein the control unit is further used for:

recording or reporting, in response to a situation that the internal pressure drops to the second pressure level, a trapped position of the robotic device; and planning a travel route of the robotic device according to the trapped position, wherein the travel route excludes the trapped position.

5. The inflation mechanism according to claim 1, wherein the inflatable air bag comprises a plurality of partition walls dividing an interior of the inflatable air bag into a plurality of sub-chambers.

6. The inflation mechanism according to claim 5, wherein the pressure detecting unit comprises a plurality of pressure detectors respectively coupled to the sub-chambers for detecting a chamber pressure of each of the sub-chambers.

7. The inflation mechanism according to claim 6, wherein the control unit is further used for:

determining an obstacle position according to a change of each of the chamber pressures.

8. The inflation mechanism according to claim 5, wherein each of the partition walls has at least an air hole through which is allowing air or gas communication between the sub-chambers.

9. The inflation mechanism according to claim 1, wherein the inflatable air bag is a hollow annular tube.

10. The inflation mechanism according to claim 9, wherein the inflatable air bag is mounted on the outer surface of the body, an outer diameter of the inflatable air bag is greater than a diameter of the body when the inflatable air bag is inflated.

11. The inflation mechanism according to claim 1, wherein the pressure adjusting unit comprises:

a pressing motor coupled to the inflatable air bag via a tube for inflating the inflatable air bag; and a pressure regulating valve disposed in the tube for maintaining the internal pressure of the inflatable air bag.

12. The inflation mechanism according to claim 1, wherein the robotic device provides a human-machine interface through which a user inputs the set condition.

13. A system comprising the inflation mechanism according to claim 1, wherein the control unit is coupled to a steering unit, a power supply unit, a detection unit and a cleaning unit.

14. A control method of an inflation mechanism, wherein the inflation mechanism adapted to a robotic device comprises an inflatable air bag, a pressure detecting unit, a pressure adjusting unit and a control unit, and the control method comprises:

detecting an internal pressure of the inflatable air bag by the pressure detecting unit; and processing a signal received from the pressure detecting unit and controlling the pressure adjusting unit by the control unit to adjust the internal pressure of the inflatable air bag according to a set condition which refers to an amount of change in the internal pressure of the inflatable air bag, wherein the control unit identifies an event according to the amount of change in the internal pressure of the inflatable air bag and outputs a signal for controlling the pressure adjusting unit to adjust the internal pressure of the inflatable air bag according to the identified event;

controlling, in response to the event, the robotic device to perform a first obstacle avoidance procedure; and controlling, in response to a situation that the robotic device performs the first obstacle avoidance procedure but still cannot avoid the obstacle, the pressure adjusting unit to deflate the inflatable air bag until the internal pressure of the inflatable air bag drops to a first pressure level from an initial pressure level and a volume of the inflatable air bag is reduced.

15. The control method according to claim 14, further comprising:

controlling, by the control unit in response to the event, the pressure adjusting unit to inflate or deflate the inflatable air bag to present an anthropomorphic emotion setting or enabling one or more functional operations of the robotic device.

16. The control method according to claim 14, further comprising:

controlling, by the control unit in response to an internal pressure drops to the first pressure level, the robotic device to perform a second obstacle avoidance procedure;

controlling, by the control unit in response to a situation that the robotic device performs the second obstacle avoidance procedure and successfully avoids the obstacle, the pressure adjusting unit to inflate the inflatable air bag until an internal pressure of the inflatable air bag increases to an initial pressure level; and controlling, by the control unit in response to a situation that the robotic device performs the second obstacle avoidance procedure but still cannot avoid the obstacle, the pressure adjusting unit to deflate the inflatable air bag until the internal pressure of the inflatable air bag drops to a second pressure level;

wherein the second pressure level is lower than the first pressure level, and the first pressure level is lower than the initial pressure level.

17. The control method according to claim 16, further comprising:

recording or reporting, by the control unit in response to an internal pressure drops to the second pressure level, a trapped position of the robotic device; and planning a travel route of the robotic device according to the trapped position by the control unit, wherein the travel route excludes the trapped position.

18. The control method according to claim 14, wherein the inflatable air bag comprises a plurality of partition walls dividing an interior of the inflatable air bag into a plurality of sub-chambers.

19. The control method according to claim 18, wherein the pressure detecting unit comprises a plurality of pressure detectors respectively coupled to the sub-chambers for detecting a chamber pressure of each of the sub-chambers.

20. The control method according to claim 19, further comprising:

determining an obstacle position according to a change of each of the chamber pressures.

21. The control method according to claim 14, wherein the robotic device provides a human-machine interface through which a user inputs the set condition.

* * * * *